US006148972A

United States Patent [19]

Wei-Chih

[11] Patent Number: 6,148,972

[45] Date of Patent: Nov. 21, 2000

[54] SIDE HANDLE PROTECTION FRAME OF A SUITCASE

[75] Inventor: Chen Wei-Chih, Taichung Hsien, Taiwan

[73] Assignee: Yung Ta Hardware & Plastic Co., Ltd., Taichung Hsien, Taiwan

[21] Appl. No.: 09/313,306

[22] Filed: May 17, 1999

[51] Int. Cl.[7] ..... A45C 5/14; A45C 13/26; A45C 13/36

[52] U.S. Cl. ..... 190/114; 190/18 A; 190/39; 190/115; 190/126

[58] Field of Search ..... 190/18 A, 39, 190/114, 115, 126

[56] References Cited

U.S. PATENT DOCUMENTS

| | | | |
|---|---|---|---|
| 3,052,333 | 9/1962 | Ikelheimer | 190/126 |
| 3,203,517 | 8/1965 | Stein | 190/126 |
| 5,108,119 | 4/1992 | Huang | 190/18 A X |
| 5,431,428 | 7/1995 | Marchwiak et al. | 190/18 A X |

*Primary Examiner*—Sue A. Weaver
*Attorney, Agent, or Firm*—Harrison & Egbert

[57] ABSTRACT

A side handle protection frame of suitcase having an inner cover panel and an outer cover panel which can be opened at the side of the suitcase. The outside of the inner cover panel is provided with a side handle at the center, and the outer cover panel is provided with an elongated hole at the center. The outer cover plate is folded up on the surface of inner cover panel so that the side handle passes through the elongated hole and appears on the surface of outer cover panel. The inner cover panel and outer cover panel are both locked by a lock. An inner edge of the elongated hole of the outer cover plate is provided with a protection frame having a concave trough at an outer edge so as to enable the inner edge of elongated hole of outer cover panel to insert into the concave trough of the protection frame. At the top and bottom of the protection frame, there are indentations for enabling the thread to attach the protection frame to the outer cover plate.

1 Claim, 5 Drawing Sheets

SIDE HANDLE PROTECTION FRAME OF A SUITCASE

BACKGROUND OF THE INVENTION

1. Field of the Invention

The present invention relates generally to a suitcase, and more particularly to a side handle protection frame of the suitcase.

2. Description of the Related Art

As shown in FIG. 1, a prior art retractable handle, stand up suitcase 10 is provided with a handle 11 at one top end thereof. The handle 11 can move the suitcase 10 in an upright position. There is a side handle 12 provided at one side of the suitcase 10 in order to orient the suitcase 10 horizontally. However, the side of said suitcase 10 cannot be opened, so that the suitcase must be stood up if the user wants to take out the articles. Such a prior art suitcase as described above is defective in design and is not convenient in use.

BRIEF SUMMARY OF THE INVENTION

The primary objective of the present invention is therefore to provide a side handle protection frame of a suitcase with an outer cover panel, a protection frame, and a side handle.

The objective, features, functions, and advantages of the present invention will be readily understood upon a thoughtful deliberation of the following detailed description of a preferred embodiment of the present invention with reference to the accompanying drawings.

BRIEF DESCRIPTION OF THE SEVERAL VIEWS

DETAILED DESCRIPTION OF THE INVENTION

Figure 1:
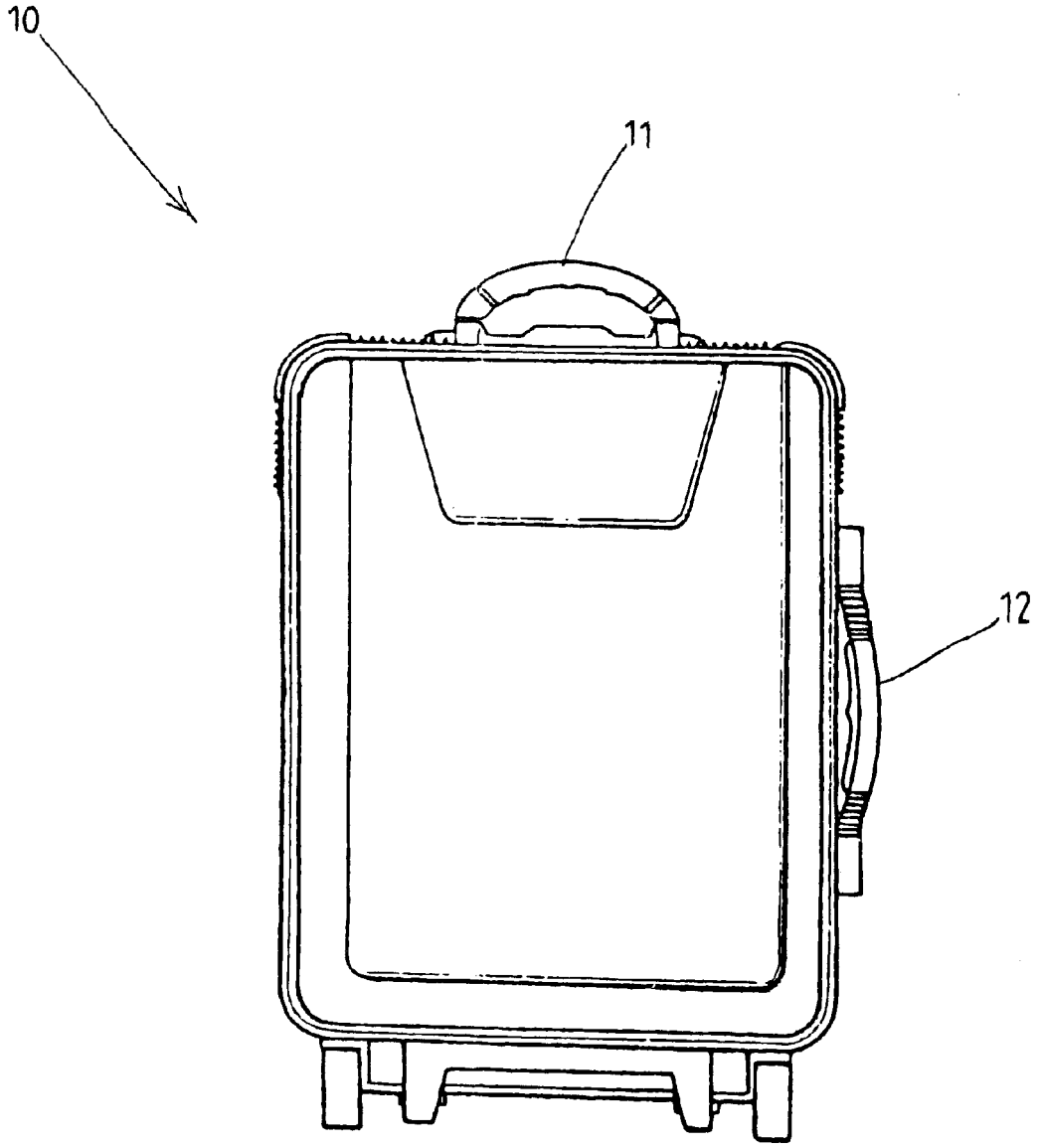
FIG.1 PRIOR ART
FIG. 1 shows a perspective view of the prior art suitcase.
Figure 2:
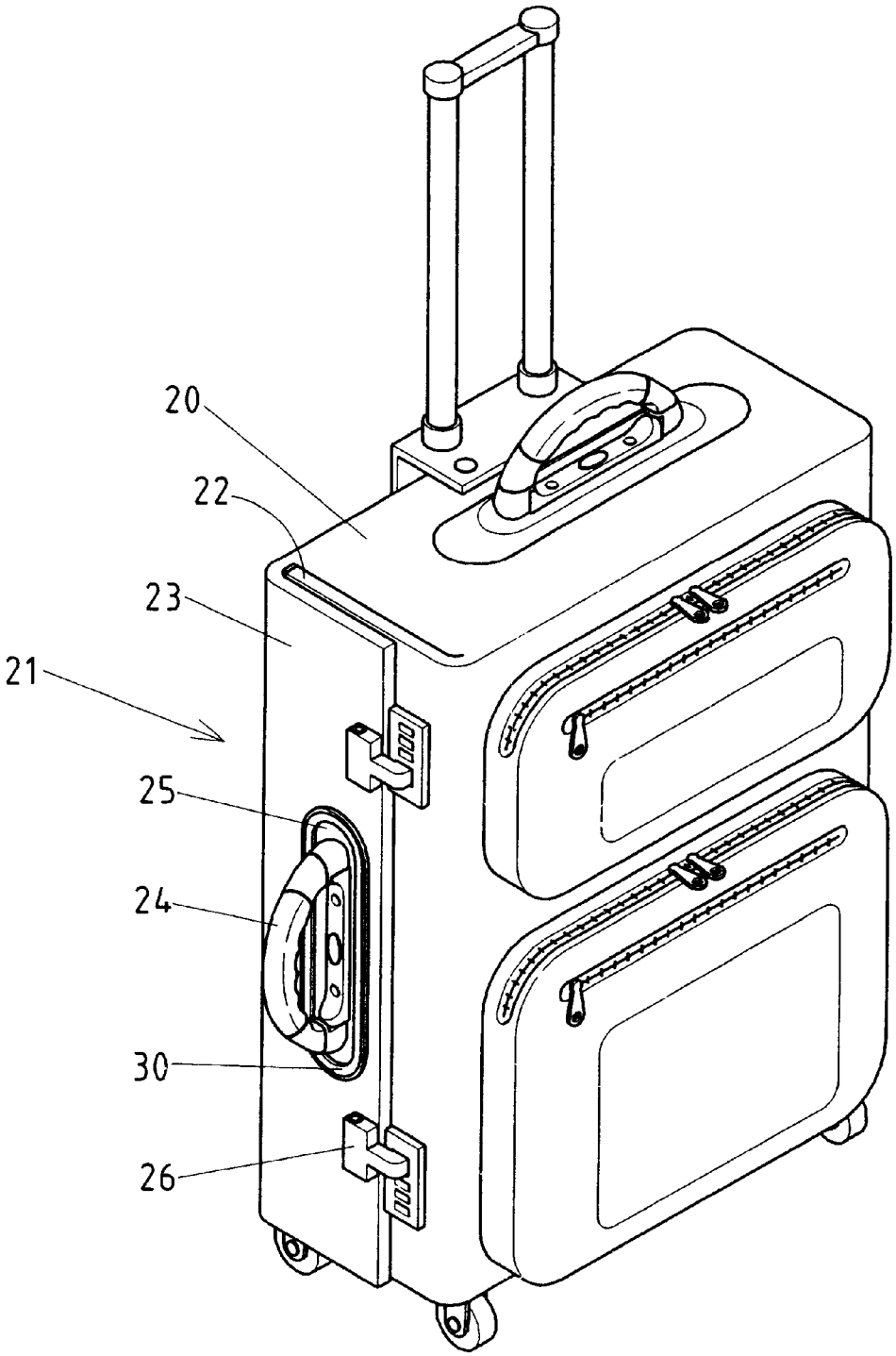
FIG. 2 shows a perspective view of the preferred embodiment of the present invention.
Figure 3:
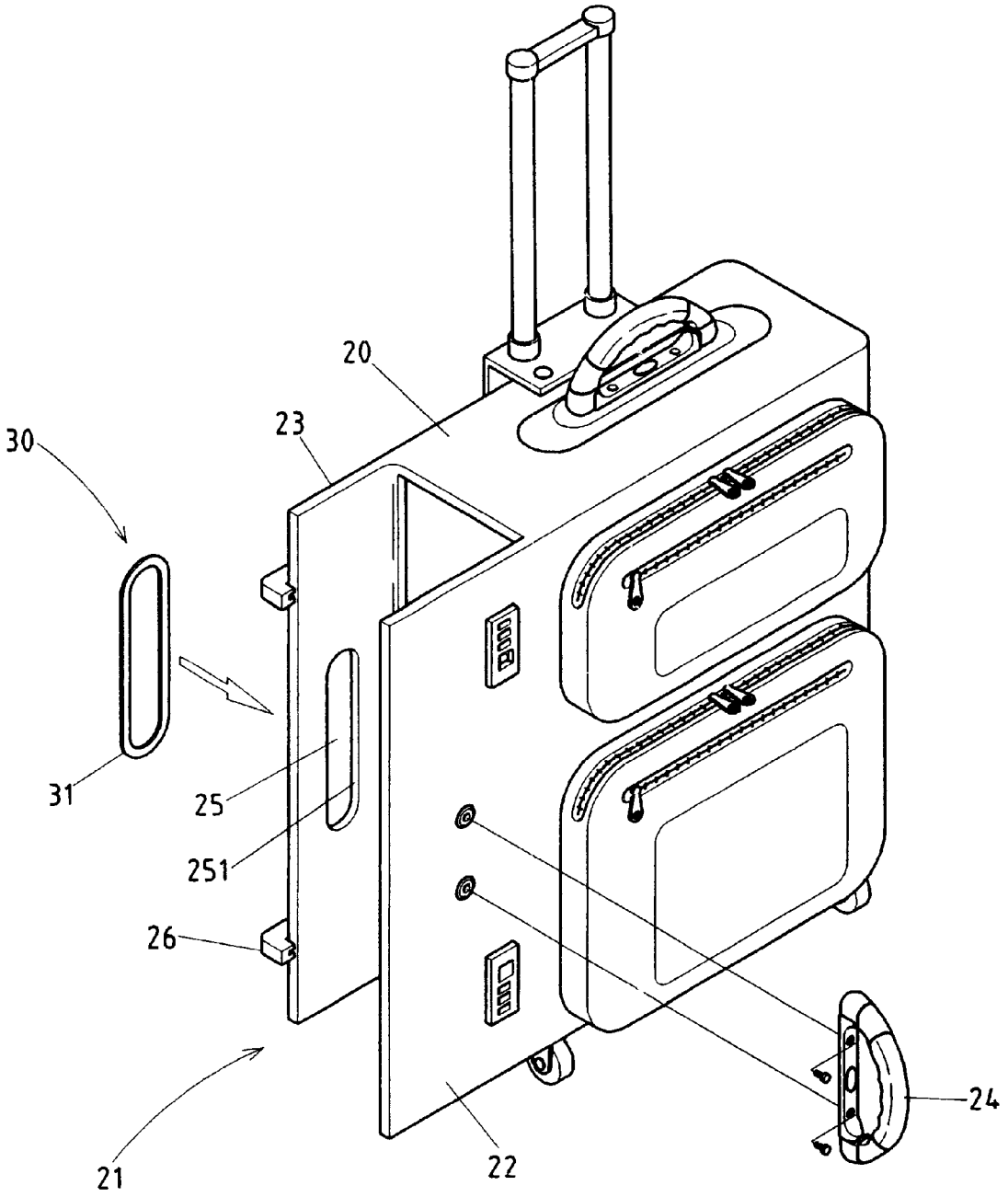
FIG. 3 shows an exploded view of the preferred embodiment of the present invention.
Figure 4:
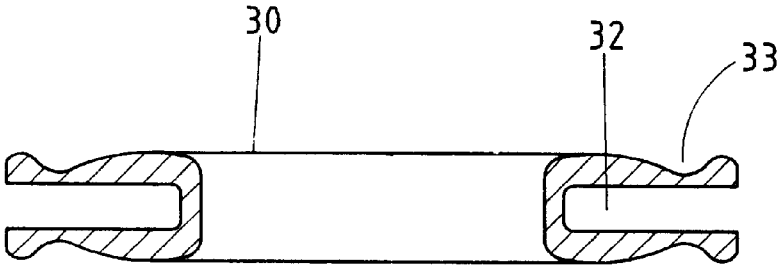
FIG. 4 shows a schematic view of a protection frame of the preferred embodiment of the present invention.

As illustrated in FIGS. 2, 3, and 4, a side handle of the present invention is composed of an inner cover panel 22 and an outer cover panel 23 which can be opened at the side 21 of the suitcase 20. The outside of the inner cover panel 22 is provided with a side handle 24 at the center, and the outer cover panel 23 is provided with an elongated hole 25 at the center. The outer cover panel 23 is folded up over the surface of inner cover panel 22, so that the side handle 24 passes through the elongated hole 25 and appears on the surface of outer cover panel 23. In addition, the inner cover panel 22 and the outer cover panel 23 are both locked by a lock 26.

The inner edge 251 of elongated hole 25 of outer cover panel 23 is provided with a protection frame 30. The outer edge 31 is formed with a concave trough 32 opposite to the inner edge 251 of elongated hole 25 of outer cover plate 23, so as to enable said inner edge 251 of elongated hole 25 of outer cover panel 23 to be inserted into the concave trough 32 of protection frame 30. Furthermore, at the top and bottom of protection frame 30, there are indentations 33 for enabling the thread 40 to attach the protection frame 30 to the outer cover panel 23. The side handle of the present invention prevents the outer cover panel from cracking.

The present invention has advantages which are described hereinafter.

Figure 5:
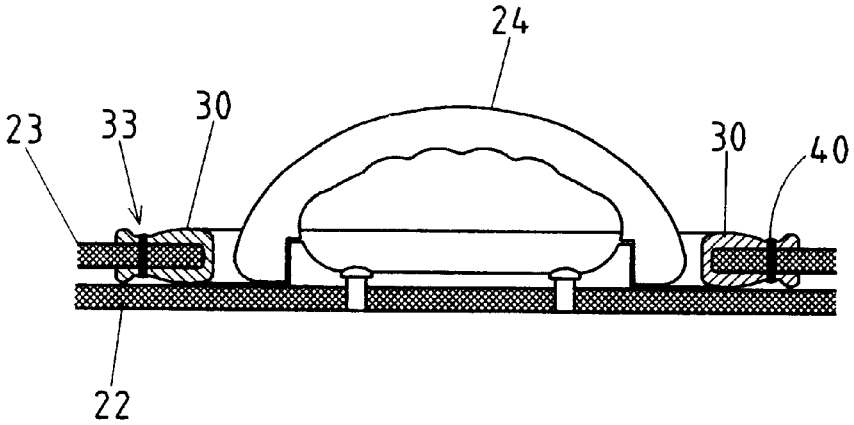
FIG. 5 shows a sectional view of the preferred embodiment of the present invention.
Figure 6:
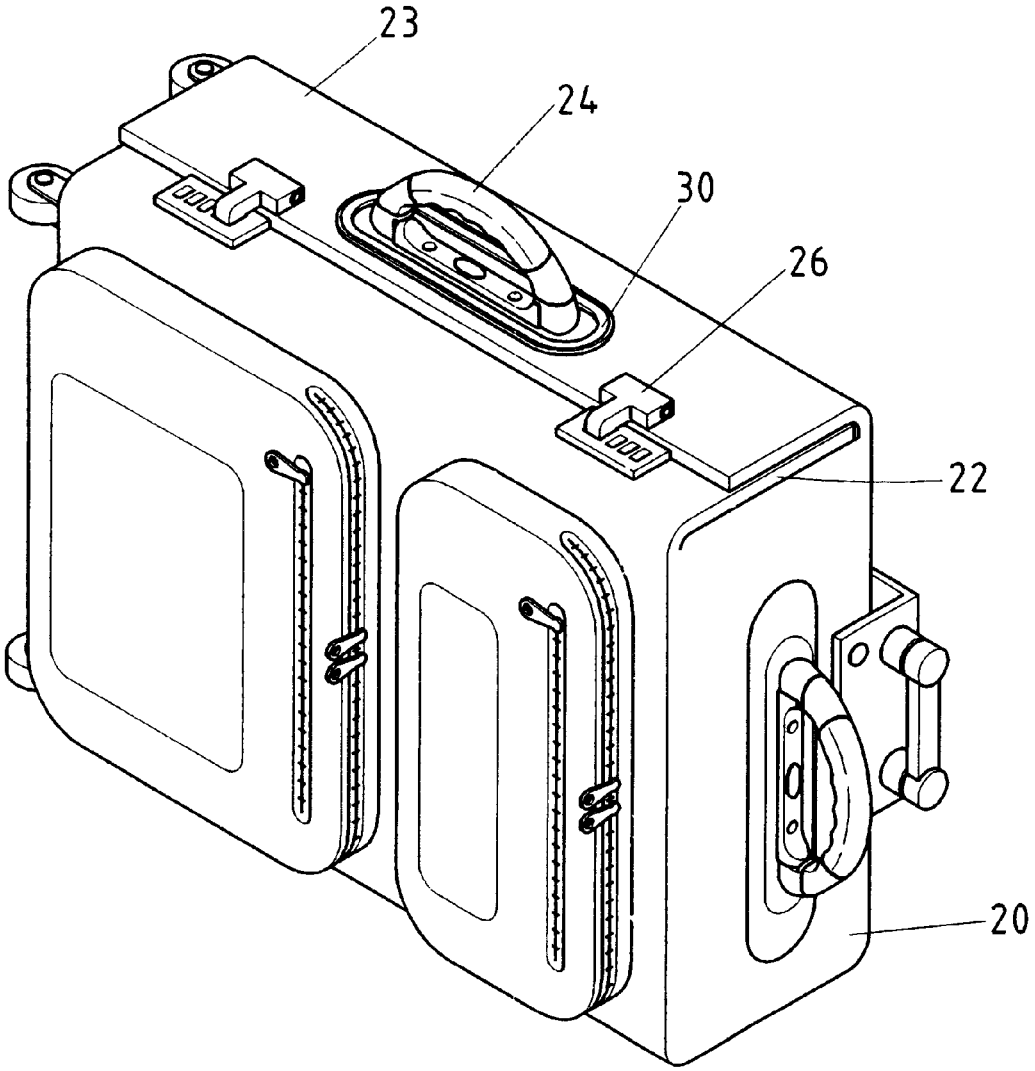
FIG. 6 shows a perspective view the preferred embodiment of the present invention in horizontal position.

As illustrated in FIGS. 4, 5, and 6, the present invention uses protection frame 30 to protect the inner edge 251 of elongated hole 25 of outer cover panel 23 by inserting the edge 251 into the concave trough 32 of said protection frame 30. Thus, the inner edge 251 of elongated hole 25 of outer cover panel 23 can be protected securely. Moreover, the top and bottom of protection frame 30 utilize the indentation 33 for aligning the thread 40, so that the thread 40 is not revealed outside and rubbed by outer forces.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

I claim:

1. A suitcase apparatus comprising:

a suitcase body having a side opening and a top handle affixed to a top end thereof;

an inner cover panel hingedly connected to said suitcase body along an edge of said side opening;

an outer cover panel hingedly connected to said suitcase body along an opposite edge of said side opening;

a side handle affixed to a center of an exterior surface of said inner cover panel, said outer cover panel having a elongated hole formed centrally thereof such that when said outer cover panel is folded against said exterior surface of said inner cover panel, said side handle extends outwardly of said outer cover panel through said elongated hole;

a lock affixed to said inner cover panel and said outer cover panel such that said outer cover panel is releasably locked against said inner cover panel; and a protection frame having a concave trough extending inwardly around a perimeter of said protection frame, said protection frame having a top side and a bottom side, said elongated hole having an edge extending therearound, said edge of said elongated hole insertably received within said concave trough of said protection frame, each of said top side and said bottom side of said protection frame having an indentation extending therearound, said protection frame threadedly secured to said outer cover panel by a thread affixed in the indentation and extending through said outer cover panel.

* * * * *